US007230614B2

(12) United States Patent
Kim et al.

(10) Patent No.: US 7,230,614 B2
(45) Date of Patent: Jun. 12, 2007

(54) CIRCUIT FOR DRIVING DISPLAY

(75) Inventors: Hak Su Kim, Seoul (KR); Minho Lee, Seoul (KR); Young-Wan Cho, Seoul (KR); Seung-Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 561 days.

(21) Appl. No.: 10/151,928

(22) Filed: May 22, 2002

(65) Prior Publication Data

US 2002/0175884 A1 Nov. 28, 2002

(30) Foreign Application Priority Data

May 22, 2001 (KR) ..... 2001-28006
Jul. 6, 2001 (KR) ..... 2001-40453
Jul. 6, 2001 (KR) ..... 2001-40454

(51) Int. Cl.
*G09G 5/00* (2006.01)

(52) U.S. Cl. ..... 345/211; 345/209

(58) Field of Classification Search ..... 345/76–83, 345/44–46, 96, 209, 211; 315/160.3
See application file for complete search history.

(56) References Cited

U.S. PATENT DOCUMENTS

| | | | | |
|---|---|---|---|---|
| 4,594,589 | A | 6/1986 | Ohba et al. | 340/805 |
| 5,714,968 | A | 2/1998 | Ikeda | 345/77 |
| 5,770,923 | A | 6/1998 | Beard | 315/169.3 |
| 5,838,289 | A * | 11/1998 | Saito et al. | 345/79 |
| 5,852,426 | A * | 12/1998 | Erhart et al. | 345/96 |
| 5,943,030 | A | 8/1999 | Minamibayashi | 345/60 |
| 6,028,573 | A * | 2/2000 | Orita et al. | 345/66 |
| 6,229,506 | B1 | 5/2001 | Dawson et al. | 345/82 |
| 6,559,603 | B2 * | 5/2003 | Iwami | 315/169.1 |

FOREIGN PATENT DOCUMENTS

| | | |
|---|---|---|
| EP | 0274380 A2 | 1/1988 |
| EP | 0377956 A1 | 7/1990 |
| JP | 59-167492 | 11/1984 |
| JP | 9-146490 | 6/1997 |
| JP | 11-338416 | 10/1999 |
| JP | 2000-148093 | 5/2000 |
| JP | 2000148093 | 5/2000 |

OTHER PUBLICATIONS

Japanese Office Action dated Sep. 7, 2005.
Higgins ML: "High-quality Electroluminescent Display for a Personal Workstation," Hewlett-Packard Journal, Hewlett-Packard Co. Palo Alto, US, vol. 36, No. 10, Oct. 1, 1995, pp. 12-17.

* cited by examiner

*Primary Examiner*—Kent Chang
(74) *Attorney, Agent, or Firm*—Ked & Associates

(57) ABSTRACT

The present invention relates to a display, and more particularly, to circuit for driving a display of a low power consumption. For the purpose, the circuit includes a light emitting display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a column driving circuit connected to the column electrode lines formed in the column direction for supplying/discharging a current to/from the column electrode lines, for driving the light emitting display of current driven type, and an electric transformer for, when the current supplied to the column electrode lines is discharged, recovering the current discharged from the column electrode lines and re-supplying a recovered current to the power source part.

8 Claims, 12 Drawing Sheets

REPLACEMENT SHEET
FIG. 5
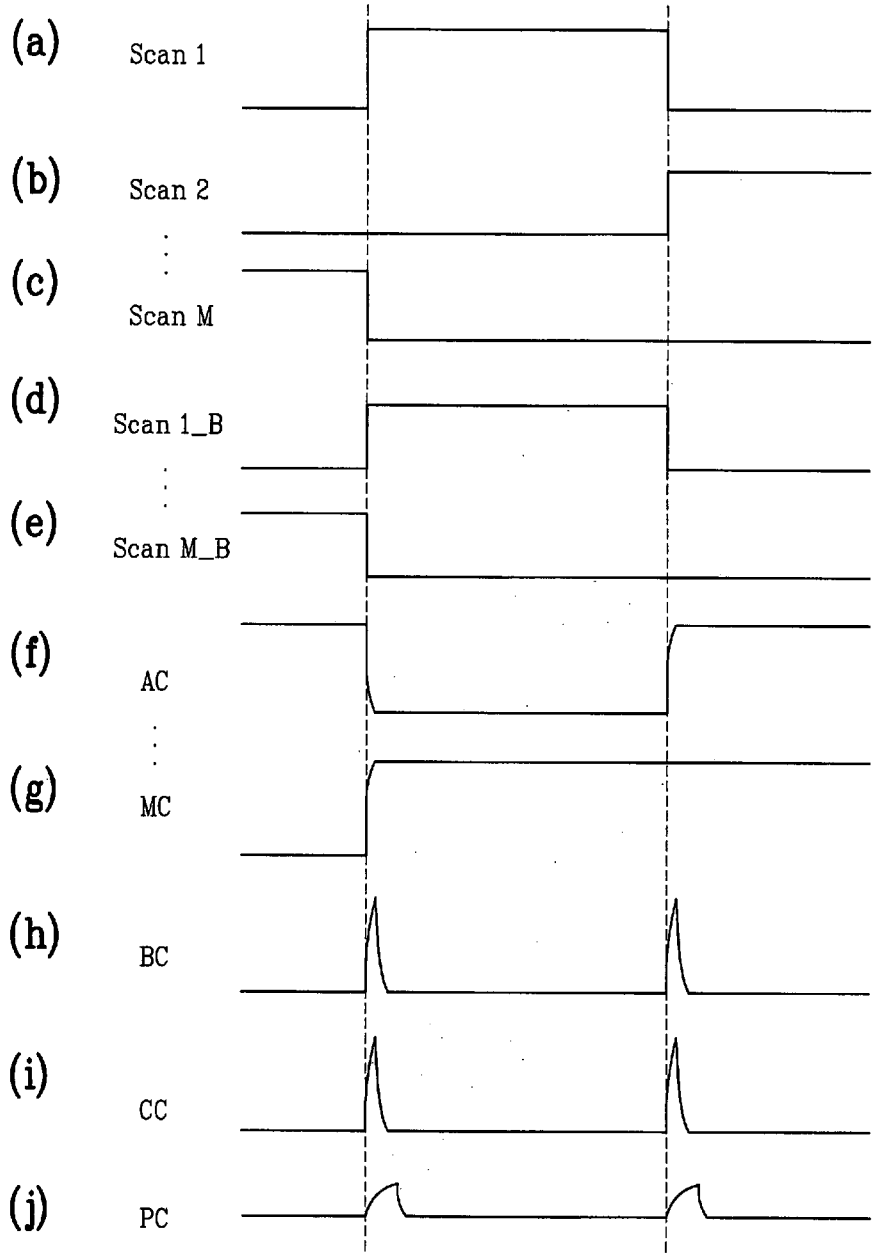

CIRCUIT FOR DRIVING DISPLAY

This application claims the benefit of the Korean Application Nos. P2001-28006 filed on May 22, 2001, P2001-40453 filed on Jul. 6, 2001, and P2001-40454 filed on Jul. 6, 2001, which are hereby incorporated by reference.

BACKGROUND OF THE INVENTION

1. Field of the Invention

The present invention relates to a display, and more particularly, to a circuit for driving a display of a low power consumption.

2. Background of the Related Art

Recently, passing ahead CRTs (Cathode Ray Tubes) that have been used the most widely, the flat displays, shown up starting particularly from the LCD (Liquid Crystal Display) at the fore front, are developed rapidly in the fields of PDP (Plasma Display Panel), VFD (Vacuum Fluorescent Display), FED (Field Emission Display), LED (Light Emitting Diode), EL (Electroluminescence), and the like.

Because the foregoing displays of a current driven type have, not only good vision and color feeling, but also a simple fabrication process, the displays are widening fields of their applications.

However, the display of a current driven type consumes more current both at the display and a driving circuit thereof as a panel of the display becomes larger. Moreover, the display of a current driven type requires more current for obtaining a desired luminance as a resolution of the display of a current driven type becomes higher because a time period allowed for driving becomes shorter due to a physical quantity required for the display.

Currently, despite the unfavorable characteristics in a response time, an angle of view, the color feeling, and the like, the major reason the LCD is used the most widely is that the LCD has a very small power consumption.

Of course, though the power consumption of the LCD is not small when the back light is taken into account, recently, the LCD of a transflective type, or a reflective type, that permits to dispense with the back light, is employed.

Recently, an organic EL display is paid attention as a flat display that occupies a small space following fabrication of large sized display. FIG. 1 illustrates a related art organic EL driving circuit.

Referring to FIG. 1, the related art organic EL display panel driving circuit is provided with a power source Vdd for applying a voltage to elements, a data driving part of a PMOS for controlling a current from the power source to an anode of an light emitting device 2 in response to a data signal, a data sink part 3 of an NMOS, a scan driving part 4 of an NMOS for making a cathode voltage from the light emitting device 2 conductive in response to a scan signal, and a scan controlling part 5 of a PMOS for applying an inverse voltage to the scan driving part 4.

The other side of the scan driving part 4 is connected to the ground, directly. The data signal and the scan signal applied to the data driving part 1 and the scan driving part 4 respectively are controlled by the controller (not shown).

The scan controlling part 5 has a power supplied from the Vpp, an inverse voltage, and is connected to a cathode of the light emitting device 2. The inverse voltage serves to prevent cross talk of the light emitting device 2.

The foregoing display has smaller power consumption in comparison to the CRT, no distortion at edge parts, and permits to fabricate an extra thin display. Moreover, the foregoing display permits fabrication of a large sized screen because it is robust in comparison to the LCD and has a wider angle of view owing to self-luminescence and a good responsive characteristics, has a wide range of service temperature of −40°–+70°, permits to select a wide variety of colors without restraints, and is operative even with a voltage as low as 15V.

However, a major reason the LCDs, which have more unfavorable characteristics than the displays of a current driven type with the foregoing advantages, are employed in portable information devices and the like more than the displays of a current driven type is that the organic ELs have a power consumption greater than the LCDs.

Since the great power consumption of the portable information terminal devices rises as a great problem as use of the portable information terminal devices increases, the problem acts as a factor that restricts use of the display of a current driven type.

However, in general, though the power consumption of the display of a current driven type is a few times of the LCD, this simple comparison has no meaning. That is, if the back light of the LCD is included, there is not so much difference of power consumption between the LCD and the display of a current driven type.

Moreover, if the power consumption of the display of a current driven type is reduced by approx. half from a total level, a total power consumption of the display of a current driven type can be reduced to a level almost the same with the LCD.

SUMMARY OF THE INVENTION

Accordingly, the present invention is directed to circuit and method for driving a display that substantially obviates one or more of the problems due to limitations and disadvantages of the related art.

An object of the present invention is to provide circuit for driving a display, which can reduce total power consumption.

Another object of the present invention is to provide a circuit for driving a display, which can reduce power consumption by recovering a power waste from refresh schema.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a circuit for driving a display includes a light emitting display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a column driving circuit connected to the column electrode lines formed in the column direction for supplying/discharging a current to/from the column electrode lines, for driving the light emitting display of current driven type, and an electric transformer for, when the current supplied to the column electrode lines is discharged, recovering the current discharged from the column electrode lines and re-supplying a recovered current to the power source part.

Preferably, the transformer is replaced with an inductor connected in series to a part from which a current supplied to the column electrode line is to be discharged, a charge capacitor for having the current discharged through the inductor charged thereto, and a switch for cutting off the current discharged after charging, to supply the charged current to the power supply part.

Preferably, the transformer is replaced with a plurality of diodes connected in series to a part from which a current supplied to the column electrode line is to be discharged, a control driving circuit for controlling a capacitor connected to every part between the diodes in parallel and the column driving circuit, thereby transforming the charged voltage to a higher voltage by using the capacitors and the control driving circuit, and re-supplying the voltage to the power source part.

In other aspect of the present invention, a circuit for driving a display has an organic EL display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a column driving circuit connected to the column electrode lines formed in the column direction for supplying/discharging a current to/from the column electrode lines, and an electric transformer for, when the current supplied to the column electrode lines is discharged, recovering the current discharged from the column electrode lines and re-supplying a recovered current to the power source part.

Preferably, the transformer is replaced with an inductor connected in series to a part from which a current supplied to the column electrode line is to be discharged, a charge capacitor for having the current discharged through the inductor charged thereto, and a switch for cutting off a part the current is discharged therefrom after charging, to re-supply the charged current to the power supply part.

Preferably, the transformer is replaced with a plurality of diodes connected in series to a part from which a current supplied to the column electrode line is to be discharged, a control driving circuit for controlling a capacitor connected to every part between the diodes in parallel and the column driving circuit, thereby transforming the charged voltage to a higher voltage by using the capacitors and the control driving circuit, and re-supplying the voltage to the power source part.

In another aspect of the present invention, a circuit for driving a display has a light emitting display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a row driving circuit connected to the row electrode lines formed in the row direction for supplying/discharging a current to/from the row electrode lines, for driving the light emitting display of current driven type, and an electric transformer for, when the current supplied to the row electrode lines is discharged, recovering the current discharged from the row electrode lines and re-supplying a recovered current to the power source part.

Preferably, the transformer is replaced with an inductor connected in series to a part from which a current supplied to the row electrode line is to be discharged, a capacitor for having the current discharged through the inductor charged thereto, and a switch for cutting off a part the current is discharged therefrom after charging, to re-supply the charged current to the power supply part.

Preferably, the transformer is replaced with a plurality of diodes connected in series to a part from which a current supplied to the row electrode line is to be discharged, a control driving circuit for controlling a capacitor connected to every part between the diodes in parallel and the row driving circuit, thereby transforming the charged voltage to a higher voltage by using the capacitors and the control driving circuit, and re-supplying the voltage to the power source part.

In another aspect of the present invention, a circuit for driving a display has an organic EL display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a row driving circuit connected to the row electrode lines formed in the row direction for supplying/discharging a current to/from the row electrode lines, for driving the organic EL display, and an electric transformer for, when the current supplied to the row electrode lines is discharged, recovering the current discharged from the row electrode lines and re-supplying a recovered current to the power source part.

Preferably, the transformer is replaced with, an inductor connected in series to a part from which a current supplied to the row electrode line is to be discharged, a charge for having the current discharged through the inductor charged thereto, and a switch for cutting off a part the current is discharged therefrom after charging, to re-supply the charged current to the power supply part.

Preferably, the transformer is replaced with a plurality of diodes connected in series to a part from which a current supplied to the row electrode line is to be discharged, a control driving circuit for controlling a capacitor connected to every part between the diodes in parallel and the row driving circuit, thereby transforming the charged voltage to a higher voltage by using the capacitors and the control driving circuit, and re-supplying the voltage to the power source part.

In another aspect of the present invention, a circuit for driving a display has a light emitting display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a row driving circuit connected to the row electrode lines formed in the row direction for supplying/discharging a current to/from the row electrode lines, for driving the light emitting display of current driven type, a column driving circuit connected to the column electrode lines formed in the column direction for supplying/discharging a current to/from the column electrode lines, for driving the light emitting display of current driven type, and an electric transformer for, when the current is discharged through the row electrode lines and the column electrode lines, recovering the discharged currents and re-supplying a recovered current to the power source part.

Preferably, the transformer is replaced with an inductor connected in series to a part from which the currents supplied to the column electrode line and the row electrode lines are to be discharged, a capacitor for having the currents discharged through the inductor charged thereto, and a switch for cutting off a part the current is discharged therefrom after charging, to re-supply the charged current to the power supply part.

Preferably, the transformer is replaced with a plurality of diodes connected in series to a part from which a current supplied to the column electrode line is to be discharged, and a part from which a current supplied to the row electrode line is to be discharged, a control driving circuit for controlling a capacitor connected to every part between the diodes in parallel, the column driving circuit, and the row driving circuit, thereby transforming the charged voltage to a higher voltage by using the capacitors and the control driving circuit, and re-supplying the voltage to the power source part.

In another aspect of the present invention, a circuit for driving a display has an organic EL display having a plurality of column electrode lines arranged in a column direction, a plurality of row electrode lines arranged perpendicular to the column electrode lines, and a matrix of pixels at crossing points of the column electrode lines and the row electrode lines, a power source part, a row driving circuit connected to the row electrode lines formed in the row direction for supplying/discharging a current to/from the row electrode lines, for driving the organic EL display, a column driving circuit connected to the column electrode lines formed in the column direction for supplying/discharging a current to/from the column electrode lines, for driving the organic EL display, and an electric transformer for, when the current is discharged through the row electrode lines and the column electrode lines, recovering the discharged currents and re-supplying a recovered current to the power source part.

Preferably, the transformer is replaced with an inductor connected in series to a part from which the currents supplied to the column electrode line and the row electrode lines are to be discharged, a capacitor for having the currents discharged through the inductor charged thereto, and a switch for cutting off a part the current is discharged therefrom after charging, to re-supply the charged current to the power supply part.

Preferably, the transformer is replaced with a plurality of diodes connected in series to a part from which a current supplied to the column electrode line is to be discharged, and a part from which a current supplied to the row electrode line is to be discharged, a control driving circuit for controlling a capacitor connected to every part between the diodes in parallel, the column driving circuit, and the row driving circuit, thereby transforming the charged voltage to a higher voltage by using the capacitors and the control driving circuit, and re-supplying the voltage to the power source part.

In another aspect of the present invention, a circuit for driving a display has a light emitting display of current driven type having a plurality of column electrode lines arranged in a column direction, a plurality of row electrode lines arranged perpendicular to the column electrode lines, and a matrix of pixels at crossing points of the column electrode lines and the row electrode lines, a power source part, a row driving circuit connected to the row electrode lines formed in the row direction for supplying/discharging a current to/from the row electrode lines, for driving the light emitting display of current driven type, the row driving circuit including a refresh part for being turned on once at every time point a control signal is changed for discharging a charge charged in the column electrode lines, and a column driving circuit connected to the column electrode lines formed in the column direction for supplying/discharging a current to/from the column electrode lines, for driving the light emitting display of current driven type, an electric transformer connected both to the column electrode line and the refresh part in the row driving circuit for recovering the current discharged through the refresh part in the row driving circuit, and re-supplying a recovered current to the power source part.

Preferably, the transformer is replaced with an inductor connected in series to a part from which a current is to be discharged from the column electrode lines and the refresh part in the row driving circuit, a capacitor for having the current discharged through the inductor charged thereto, and a switch for cutting off a part the current is discharged therefrom after charging, to supply the charged current to the power supply part.

Preferably, the transformer is replaced with a plurality of diodes connected in series to a part from which a current is to be discharged through the column electrode lines and the refresh part in the row driving circuit, a control driving circuit for controlling a capacitor connected to every part between the diodes in parallel, the column driving circuit, and the row driving circuit, thereby transforming the charged current to a higher voltage by using the capacitors and the control driving circuit, and re-supplying the voltage to the power source part.

In another aspect of the present invention, a circuit for driving a display has an organic EL display having a plurality of column electrode lines arranged in a column direction, a plurality of row electrode lines arranged perpendicular to the column electrode lines, and a matrix of pixels at crossing points of the column electrode lines and the row electrode lines, a row driving circuit connected to the row electrode lines formed in the row direction for supplying/discharging a current to/from the row electrode lines, for driving the organic EL display, the row driving circuit including a refresh part for being turned on once at every time point a control signal is changed for discharging a charge charged in the column electrode lines, and a column driving circuit connected to the column electrode lines formed in the column direction for supplying/discharging a current to/from the column electrode lines, for driving the organic EL display, an electric transformer connected both to the column electrode line and the refresh part in the row driving circuit for recovering the current discharged through the refresh part in the row driving circuit, and re-supplying a recovered current to the power source part.

Preferably, the transformer is replaced with an inductor connected in series to a part from which a current is to be discharged from the column electrode lines and the refresh part in the row driving circuit, a capacitor for having the current discharged through the inductor charged thereto, and a switch for cutting off a part the current is discharged therefrom after charging, to supply the charged current to the power supply part.

Preferably, the transformer is replaced with a plurality of diodes connected in series to a part from which a current is to be discharged through the column electrode lines and the refresh part in the row driving circuit, a control driving circuit for controlling a capacitor connected to every part between the diodes in parallel, the column driving circuit, and the row driving circuit, thereby transforming the charged current to a higher voltage by using the capacitors and the control driving circuit, and re-supplying the voltage to the power source part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 5 illustrates operation waveforms at various parts in FIG. 4;

DETAILED DESCRIPTION OF THE PREFERRED EMBODIMENT

Figure 2:
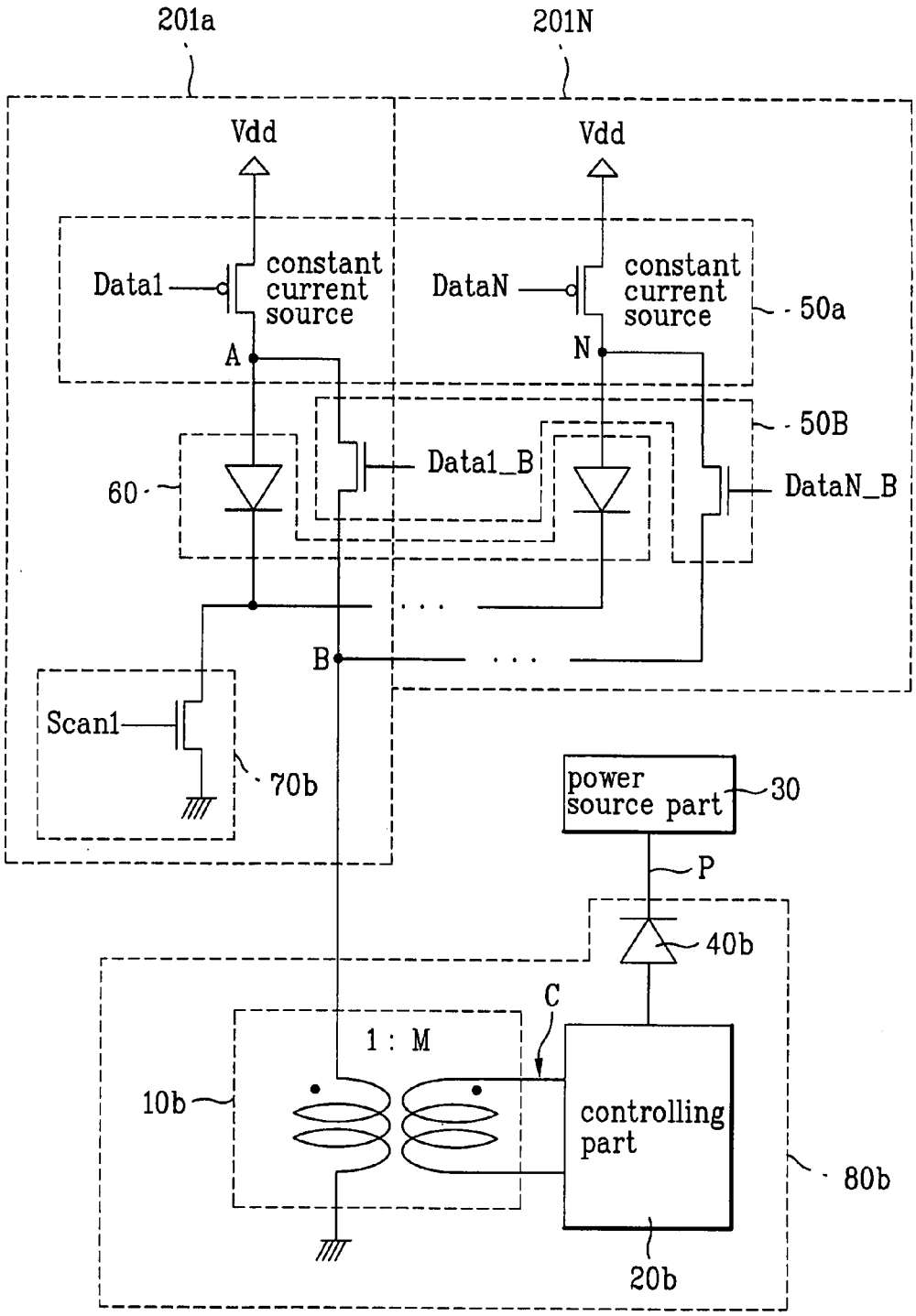
FIG. 2 illustrates a power saving circuit for a display of current driven type in accordance with a first preferred embodiment of the present invention.

Reference will now be made in detail to the preferred embodiments of the present invention, examples of which are illustrated in the accompanying drawings. FIG. 2 illustrates a power saving circuit for a display of current driven type in accordance with a first preferred embodiment of the present invention.

Referring to FIG. 2, the driving circuit of a display includes a power source for applying a source voltage to each element, a data driving part of N PMOSs each for controlling a current from the power source to the anode of the light emitting device part 60 in response to a data signal applied thereto, a data driver 50*a* of PMOSs inclusive of a data sink 50B of N NMOSs for eliminating a charge trapped in the anode, a scan driver 70*b* of M NMOSs each for making a cathode current from the light emitting device part conductive in response to a scan signal applied thereto, and a voltage transformer part 80*b* connected between the data sink part and the light emitting device part 60 for transforming a current received from the data sink part into a voltage.

The voltage transformer part 80*b* includes a transformer 10*b* for transforming a current received from the data sink part into a voltage, a controlling part 20*b* for obtaining a desired level of voltage by controlling the transformer 10*b*, and a diode 40*b* for stabilizing the obtained voltage and providing to an external power source part 30.

The power source part 30 is a kind of battery, for providing and applying Vdd and Vpp from a received voltage.

In the meantime, there are N organic EL driving parts 201*a*–201N each including one element of the data driving part, a light emitting device a light emission state of which is fixed depending on a voltage applied to the scan driving part corresponding to the element of the data driving part, and one element of the data sink part which eliminates a trapped charge from an anode line of the light emitting device.

Figure 1:
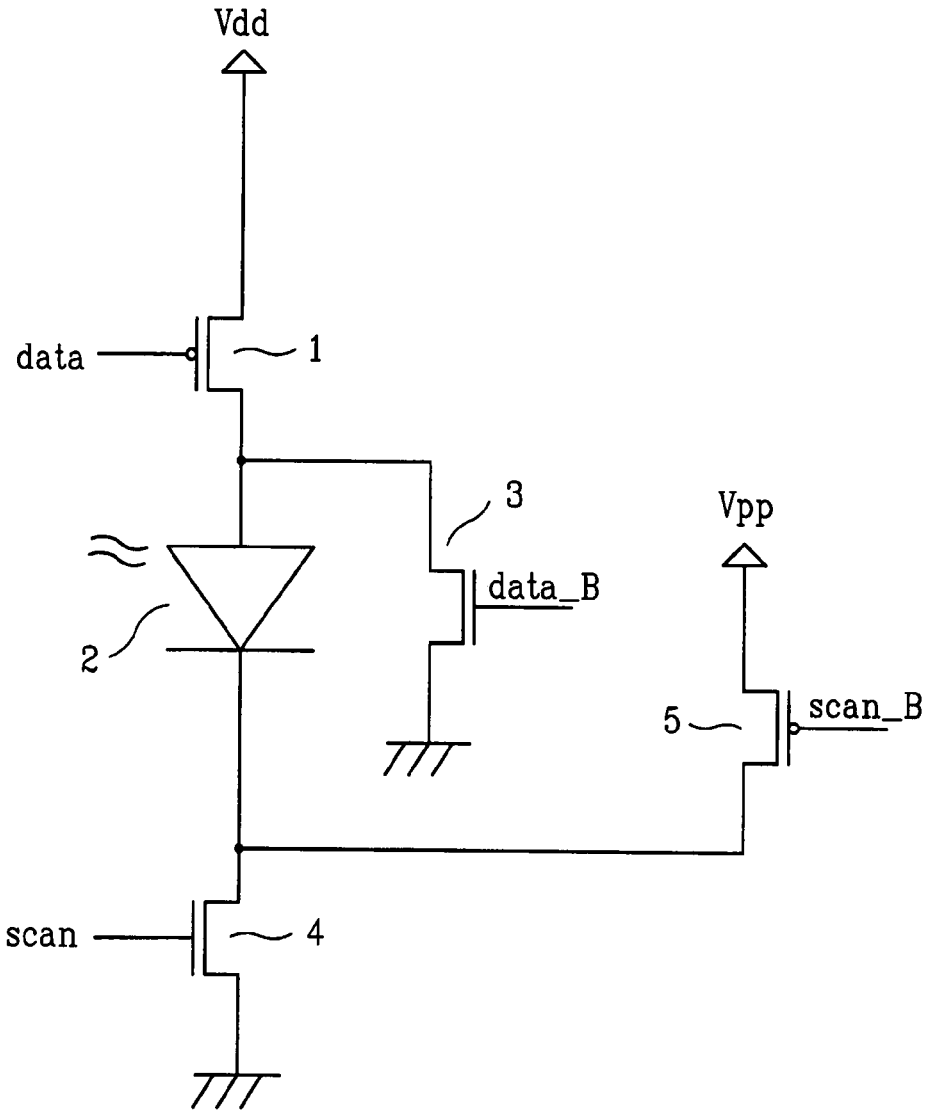
FIG. 1 Related Art
FIG. 1 illustrates a related art organic EL driving circuit.

A system of each of the organic EL driving parts 201*a*–201N is identical to FIG. 1, except that one side of each of the N data sink parts is connected to the ground through the transformer 10*b* in common.

A source of the NMOSs of the data sink part in each of the organic EL driving parts 201*a*–201N is connected to ground through the primary side coil of the transformer 10*b*, and a source of the scan driving part is in general connected to the ground, directly.

In FIG. 2, for convenience of explanation, a part at which a drain of the NMOS of the data sink part in the first organic EL driving part 201*a* and an anode of the organic EL are connected is represent with 'A', a part at which a drain of the NMOS of the data sink part in the Nth organic EL driving part 201N and the anode of the organic EL are connected is represent with 'N', and a part at which the source of the NMOS of the N data sink parts and the primary side coil of the transformer 10*b* is represented with 'B'.

An output node part of the transformer is represented with 'C', and a part at which the cathode of the diode 40*b* and the power source part 30 are connected is represented with 'P'. A signal provided to the data driving part in the organic EL driving parts 201*a*–201N and a signal provided to the data sink part are identical. Therefore, the data driving part and the data sink part are operative oppositely. That is, if the data driving part is turned on, the data sink part is turned off, and vice versa.

If the data driving part is turned on, a current is made to flow from the constant current source to the light emitting device, to make the light emitting device to emit a light, and if the data driving part is turned off, a voltage (for an example, a voltage at 'A') on the anode of the light emitting device is provided to the primary side coil of the transformer 10*b* through the data sink part.

Figure 3:
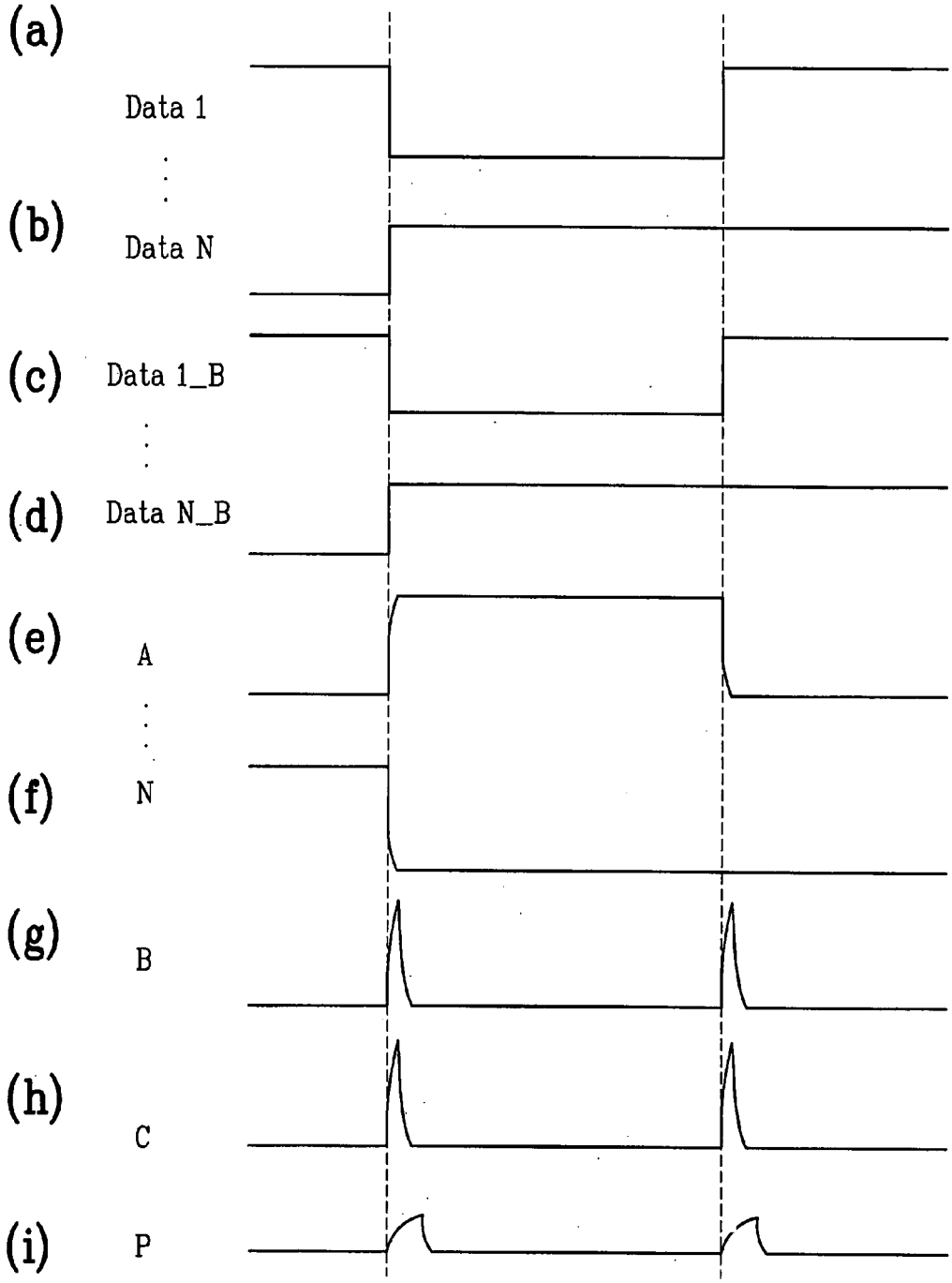
FIG. 3 illustrates operation waveforms at various parts in FIG. 2.

The operation of the power saving circuit for the display of a current driven type of the present invention will be explained in detail, with reference to the attached drawings. FIG. 3 illustrates operation waveforms at various parts in FIG. 2, wherein Data1–DataN in FIGS. 3A and 3B represent examples of signals provided to the data driving parts, and Data1_B–DataN_B in FIGS. 3C and 3D represent examples of signals provided to the data sink parts.

For an example, if a signal provided to the data driving part in the first organic EL driving part 201*a* is low, the PMOS in the data driving part is turned on such that a high voltage (i.e., the Vdd) is applied to the 'A' point as shown in FIG. 3E.

That is, in correspondence to the variation of the Data1–DataN signals, waveforms at points 'A'–'N' vary as shown in FIGS. 3E, and 3F at the anode line of the light emitting device. Waveforms at the anode line are varied with a slight time delay.

If the PMOS of the data driving part is turned on, the light emitting diode connected to the drain of the PMOS of the data driving part emits light.

When the signal provided to the data driving part of the first organic EL driving part 201*a* is turned from low to high during the light emitting device is turned on and emits light, the PMOS of the data driving part is turned off.

If the NMOS of the data sink part is turned on, a voltage at the 'A' point is provided to the primary side coil of the transformer 10*b* through the NMOS.

The voltage charged at the primary side of the transformer 10*b* is induced at the secondary side coil in proportion to the winding ratio. That is, a current at the primary side of the transformer 10*b* is transferred to the secondary side in proportion to the winding ratio 1:M of the transformer 10*b*.

A voltage at 'B' part at which one sides of all of the N NMOSs of the data sink part are connected thereto increases in proportion to a number of the data sink parts. That is, an intensity of the current flowing in the primary side coil of the transformer 10*b* varies with the voltage at the 'B' point, and the voltage varies in proportion to the intensity of the current.

This variation of voltage causes to increase a voltage at 'C' point having an output part of the transformer 10*b* connected thereto. That is, the voltage at 'C' point increases in proportion to the voltage at 'B' point and the winding ratio as shown in FIG. 3H. According to the variation, a desired level of voltage at 'P' point provided through the controlling part 20*b* and the diode 40*b* can be obtained from a voltage provided to the transformer 10*b* as shown in FIG. 3I.

When the voltage at 'P' point turns on the diode 40*b*, the power source part 30 provides power source voltages required for various parts (for an example, Vdd) from the voltage received through the diode 40*b*, and provides to the required parts. That is, by recovering and using the power consumed at the data sink to the maximum, the power source part 30 can reduce a total power of entire system.

For proper operation of the voltage transforming part 80*b* having the transformer 10*b* applied thereto, it is required that a value of an input inductance to the transformer 10*b* connected to the NMOS of the data sink part is very small.

Otherwise, a responsive time period of the NMOS of the N data sink parts becomes very slow, to affect operation of the entire system. This is because the greater the inductance, the greater the impedance.

Also, it is required that a value of the input inductance to the transformer 10*b* is substantial. If an input current does not exceed a certain level, operation condition of the voltage transforming part 80*b* having the transformer applied thereto can not be met, causing the voltage transforming part 80*b* inoperative.

Thus, when the data driving part is turned on and the data sink part is turned off, the present invention feeds the voltage to be drained to the ground through the data sink part back to the power source part, and uses the voltage. That is, by recovering and re-using the power to be drained at the data sink part to the maximum power of the entire system can be dropped.

The transformer 10*b* is a preferred embodiment of the present invention, and an inductor or a charge pump may be employed instead of the transformer.

Figure 4:
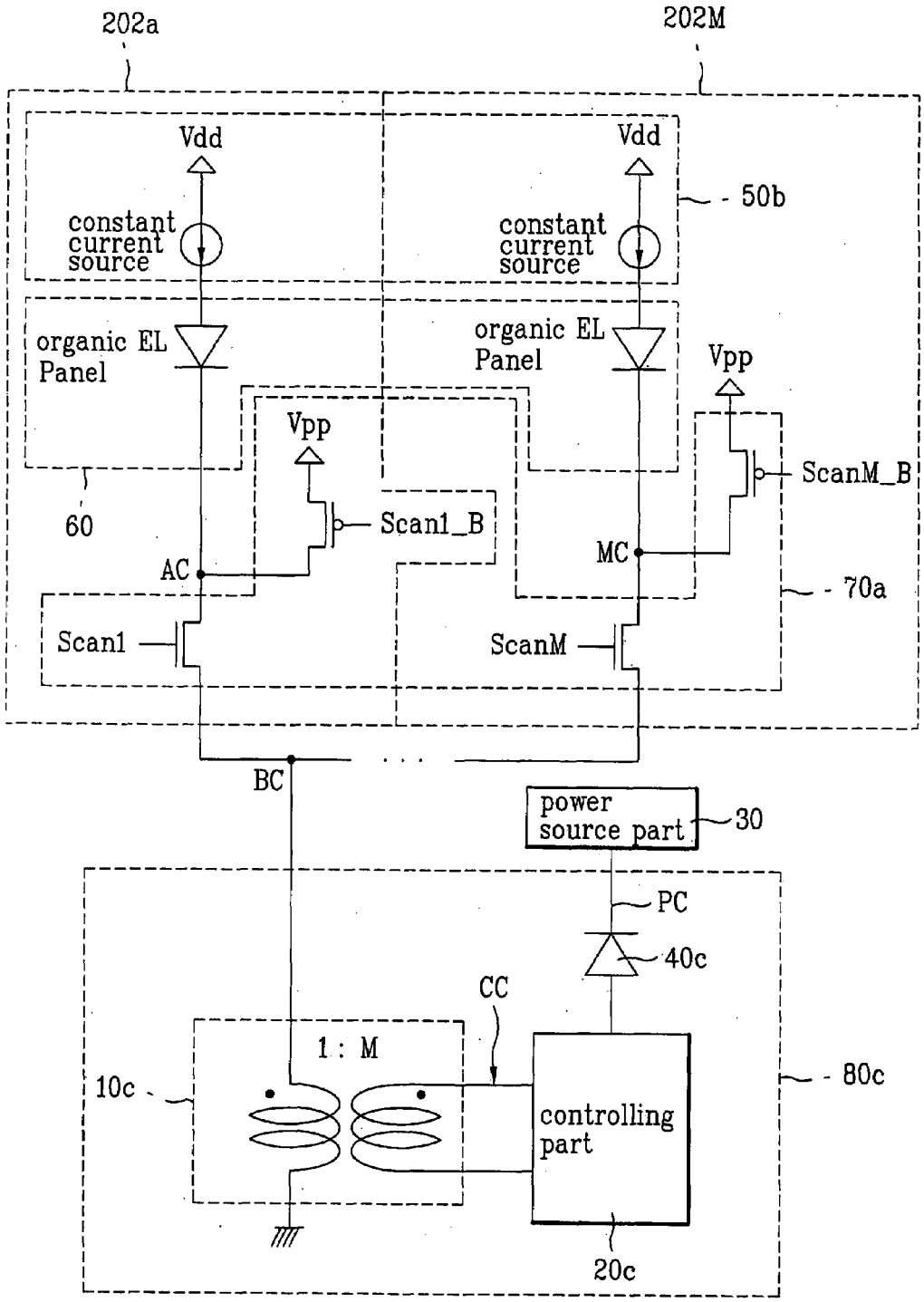
FIG. 4 illustrates a power saving circuit for a display of current driven type in accordance with a second preferred embodiment of the present invention.

FIG. 4 illustrates a power saving circuit for a display of current driven type in accordance with a second preferred embodiment of the present invention.

Referring to FIG. 4, the driving circuit of a display includes a power source Vdd for applying a voltage to various elements, a constant current source 50*b* for controlling a current to the anode of the light emitting device part by being turned on/off, a scan driver 70*a* having a scan driving part of M NMOSs for making a cathode current from the light emitting device part 60 in response to a received scan signal, and a scan controlling part having M PMOS each connected to a cathode of each device of the light emitting device part 60 for preventing cross talk, and a voltage transforming part 80*c* for transforming a current from the scan driving part to a voltage.

The voltage transforming part 80*c* includes a transformer 10*c* for transforming a current received from the scan driving part to a voltage, a controlling part 20*c* for controlling the transformer 10*c* to obtain a desired level of voltage, a diode 40*c* for stabilizing the obtained voltage and providing to an external power source part 30.

A constant voltage is applied to each of devices of the light emitting device part as the constant current source is turned on/off, according to which operation, a role of a data driver is carried out.

There are N organic EL driving parts 202*a*–202M each inclusive of a light emitting device for emitting a light as the constant current source is turned on/off, a scan driving part connected to a cathode of the light emitting device, and a scan controlling part connected to a cathode of the light emitting device for prevention of cross talk of the light emitting device.

Systems of the organic EL driving parts 202*a*–202M are identical to FIG. 1, except that one side of the scan driving part is connected to ground through the transformer 10*c*. That is, the scan driving part includes M NMOSs each driven by a scan signal, the scan controlling part includes M PMOSs each driven by a scan_B signal, and both a drain of each NMOS of the scan driving part and a source of each PMOS of the scan controlling part are connected to a cathode of one of the light emitting devices.

Signals provided to the scan driving part and the scan controlling part of each of the organic EL driving parts 202*a*–202M are the same. Therefore, the scan driving part and the scan controlling part are operative oppositely. That is, if the scan driving part is turned on, the scan controlling part is turned off, and vice versa.

Sources of the M NMOSs of the scan driving part in each of the organic EL driving parts 202*a*–202M are connected to the primary side coil of the transformer 10*c* in common. Therefore, if the scan driving part is turned on and the scan controlling part is turned off, a voltage on a cathode of the light emitting device connected to one of the M scan driving parts, which is turned on, is provided to the primary side coil of the transformer 10*c* through the scan driving part.

In FIG. 4, for convenience of explanation, a part at which a cathode of the light emitting device in the first organic EL driving part 202*a*, a drain of the scan driving part, and a source of the scan controlling part are connected in common is represented with 'AC', a cathode of the light emitting device of an Mth organic EL driving part 202M, a drain of the scan driving part, and a source of the scan controlling part are connected in common is represented with 'MC', and a part at which sources of the NMOSs of the M scan driving parts, and the primary side coil of the transformer 10*c* are connected is represented with 'BC'.

An output node part of the transformer is represented with 'CC', and a part at which a cathode of the diode 40*c* and the power source part 30 are connected is represented with 'PC'.

The operation of the foregoing power saving circuit for a display of a current driven type of the present invention will be explained in detail, with reference to the attached drawings. FIGS. 5A–5J illustrate operation waveforms at various parts in FIG. 4, wherein scan1–scanM in FIGS. 5A and 5B illustrate examples of signals provided to respective scan driving parts, and scan1_B and scanM_B in FIGS. 5C and 5D illustrate examples of signals provided to respective scan controlling parts.

For an example, if a scan signal provided to the scan driving part in the first organic EL driving part 202*a* is turned from low to high, the NMOS of the scan driving part is turned on, and the PMOS of the scan controlling part is turned off. When the NMOS of the scan driving part is turned on, a voltage on the cathode of the light emitting device, i.e., a voltage at 'AC' point is pulled down as shown in FIG. 5F, which is provided to the primary side coil in the transformer through the scan driving part.

In correspondence to changes of the scan1–scanN signals, a signal waveform is changed at a cathode line in the light emitting device as 'AC' to 'MC' waveforms in FIGS. 5F–5G.

In this instance, since a resistance of the transformer 10*c* is very small, a voltage at 'BC' point drops almost to a ground level as shown in FIG. 5H. Then, the voltage charged at the primary side of the transformer 10*c* is induced at the secondary side coil in proportion to the winding ratio. That is, a current at the primary side of the transformer 10*c* is transferred to the secondary side in proportion to a winding ratio 1:M of the transformer 10*c*.

A voltage at the point 'BC' to which one sides of all NMOSs of the N data sink part are connected increases in proportion to a number of turned on data sink parts. That is, an intensity of the current to the primary side coil of the transformer 10*c* varies with the voltage at the point 'BC', and the voltage varies with the intensity of the current. This variation of the voltage causes a voltage at the point 'CC' the output part of the transformer 10*c* is connected thereto to increase, too.

That is, as shown in FIG. 5I, the voltage at the point 'CC' increases in proportion to the voltage at the point 'BC' and the winding ratio, leading a voltage at the point 'PC' through the controlling part 20*c* and the diode 40*c* higher than the voltage to the transformer 10*c* as shown in FIG. 5J.

Then, the voltage at the point 'BC' turns on the diode 40*c*, so that the power source part 30 provides power source voltages (for examples, Vdd and Vpp) required for different parts from the voltage received through the diode 40*c*, and provides to relevant parts. That is, the power source part 30 recovers, and re-uses the power wasted at the scan driving part to the maximum, to reduce a power for the entire system.

For proper operation of the voltage transforming part 80*c* having the transformer applied thereto in the foregoing system, it is required that an inductance to the transformer 10*c* connected to the NMOS of the scan driving part is very small, otherwise a responsive time period of each of the N NMOSs of the scan driving part becomes very slow, to affect an entire system operation, because the greater the value of the inductance, the greater the impedance.

Moreover, it is required that a value of the inductance to the transformer 10*c* is substantial. Because, if a received current does not exceed a certain level, the voltage transforming part 80*c* is inoperative since an operation condition of the voltage transforming part 80*c* having the transformer 10*c* applied thereto is not met.

Thus, the present invention feeds the voltage, which is to be drained to ground through the scan driving part when the scan driving part is turned on and the scan controlling part is turned off, back to the power source part by means of the voltage transforming part, and uses the voltage. That is, a power wasted at the scan driving part is recovered and re-used to the maximum, to reduce a power for the entire system.

In this instance, the transformer 10*c* is one embodiment of the present invention, and an inductor or a charge pump may be used instead of the transformer.

Figure 6:
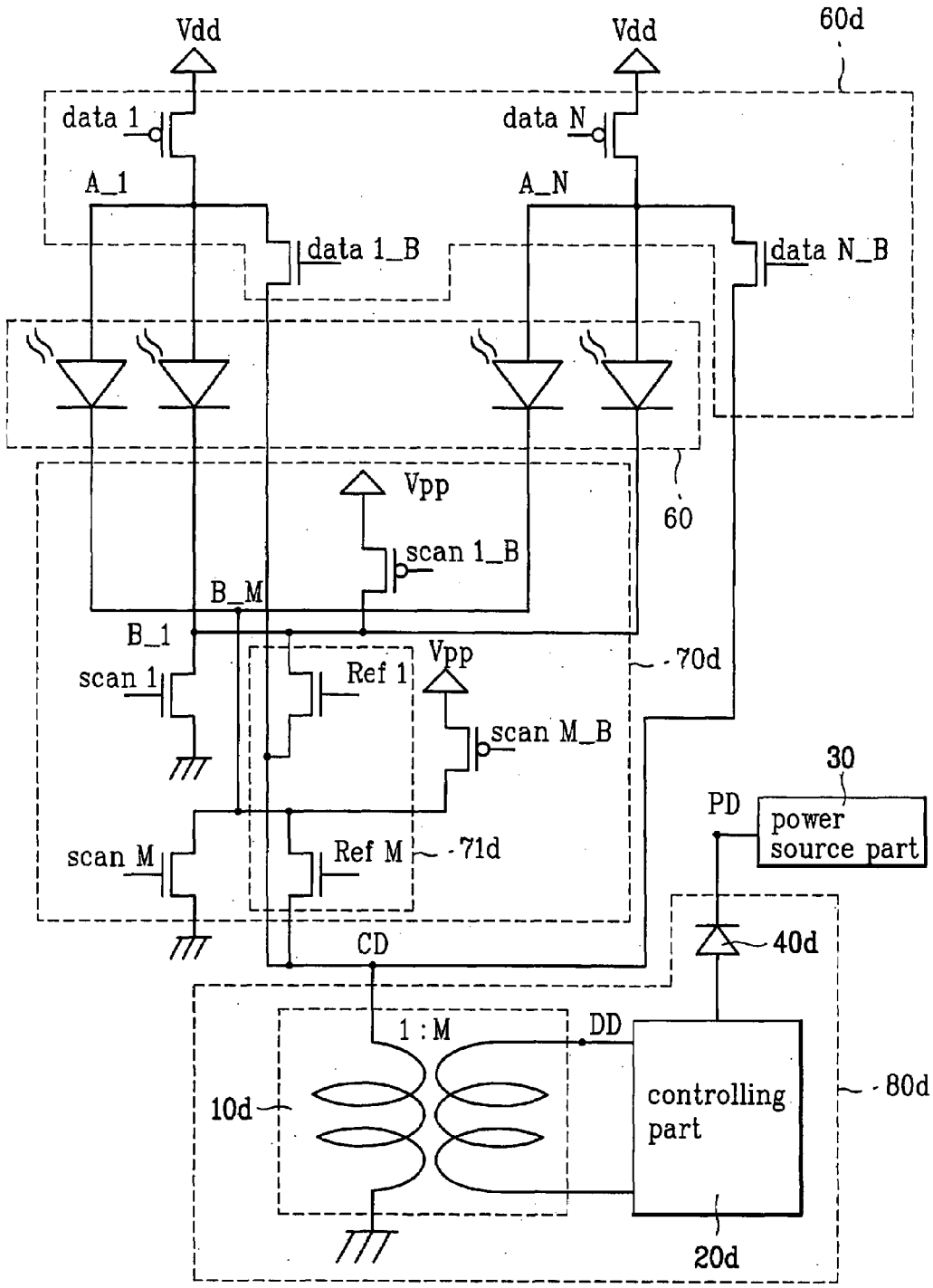
FIG. 6 illustrates a power saving circuit for a display of current driven type in accordance with a third preferred embodiment of the present invention.

FIG. 6 illustrates a power saving circuit for a display of current driven type in accordance with a third preferred embodiment of the present invention.

Referring to FIG. 6, the driving circuit for a display includes a data driver 60*d* having a power source Vdd for applying a voltage to elements, a data driving part (data 1–data N) of N PMOSs each for controlling a current from the power source to an anode on an light emitting device part 60 in response to a data signal applied respectively, a data sink part (data 1_B–data N_B) of N NMOSs connected to the anode for making a voltage conductive, which is discharged from an anode of a device as at least one device (data line) in the data driving part is turned off, a scan driver 70*d* having a scan driving part (scan 1–scan M) for making the light emitting device part to emit light in correspondence to the data line in response to the scan signal applied respectively, a scan controlling part (scan 1_B–scan M_B) for applying an inverse voltage to the scan driving part for prevention of cross talk of the light emitting device part 60, and a refresh part (Ref1–RefM) 71*d* connected to a cathode of the light emitting device part 60 between the scan driving part and the controlling part for making a voltage conductive, which is discharged from a cathode of a device as at least one device (scan line) of the scan driving part is turned on, and a voltage transforming part 80*d* connected between the data sink part and the refresh part for recovering the voltage discharged through the data sink part and/or the refresh part.

The voltage transforming part 80*d* includes a transformer 10*d* for transforming a discharge voltage from the data sink part and/or the refresh part in proportion to a preset winding ratio, a controlling part 20*d* for controlling the transformer 10*d* so as to obtain a desired level of a voltage, and a diode 40*d* for stabilizing, and providing the obtained voltage to an external power source part 30.

The transformer 10*d* includes a primary coil for receiving a voltage from the data sink part and/or the refresh part, and a secondary coil for transforming the voltage from the primary coil in proportion to the preset winding ratio, and a controlling part 20*d* for adjusting the voltage from the secondary coil to a desired level of voltage.

One sides of the data sink part and the refresh part are connected into one and therefrom connected to an input of the transformer 10*d*. A function of the refresh part may be replaced with the scan driving part. A case the refresh part is not included therein will be explained in a second embodiment, later. The M NMOS in the scan driving part are connected to ground, directly.

In the data sink part, source terminals of the data 1_B–data N_B, N sink elements, are connected into one and therefrom connected to an input of the transformer 10*d*.

Ref1–refM, refresh elements, are respectively connected between the M scan 1–scan M in the scan driving part and the scan 1_B–scan M_B, inverse voltage elements in the scan controlling part. Drain terminals of the ref1–refM are respectively connected to cathodes of the light emitting device part 60, and source terminals thereof are connected into one and, therefrom, connected to an input of the transformer 10*d*.

Accordingly, it is made that much current flows to the input of the transformer during a refresh time period.

The foregoing transformer is one of preferred embodiment of the present invention, and an inductor or a charge pump may be employed instead of the transformer.

Figure 7:
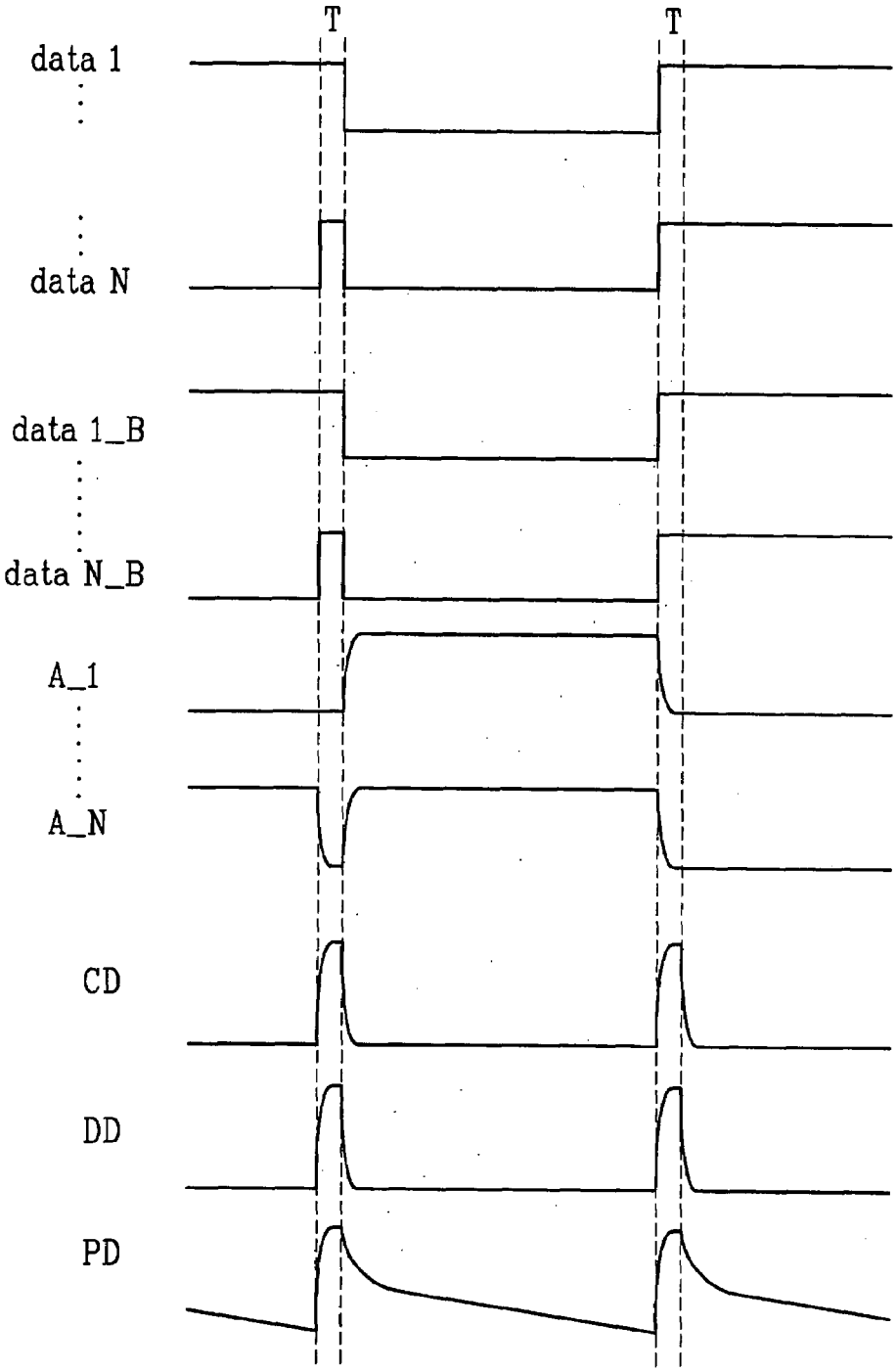
FIGS. 7 and 8 illustrate operation waveforms at parts in FIG. 6.
Figure 8:
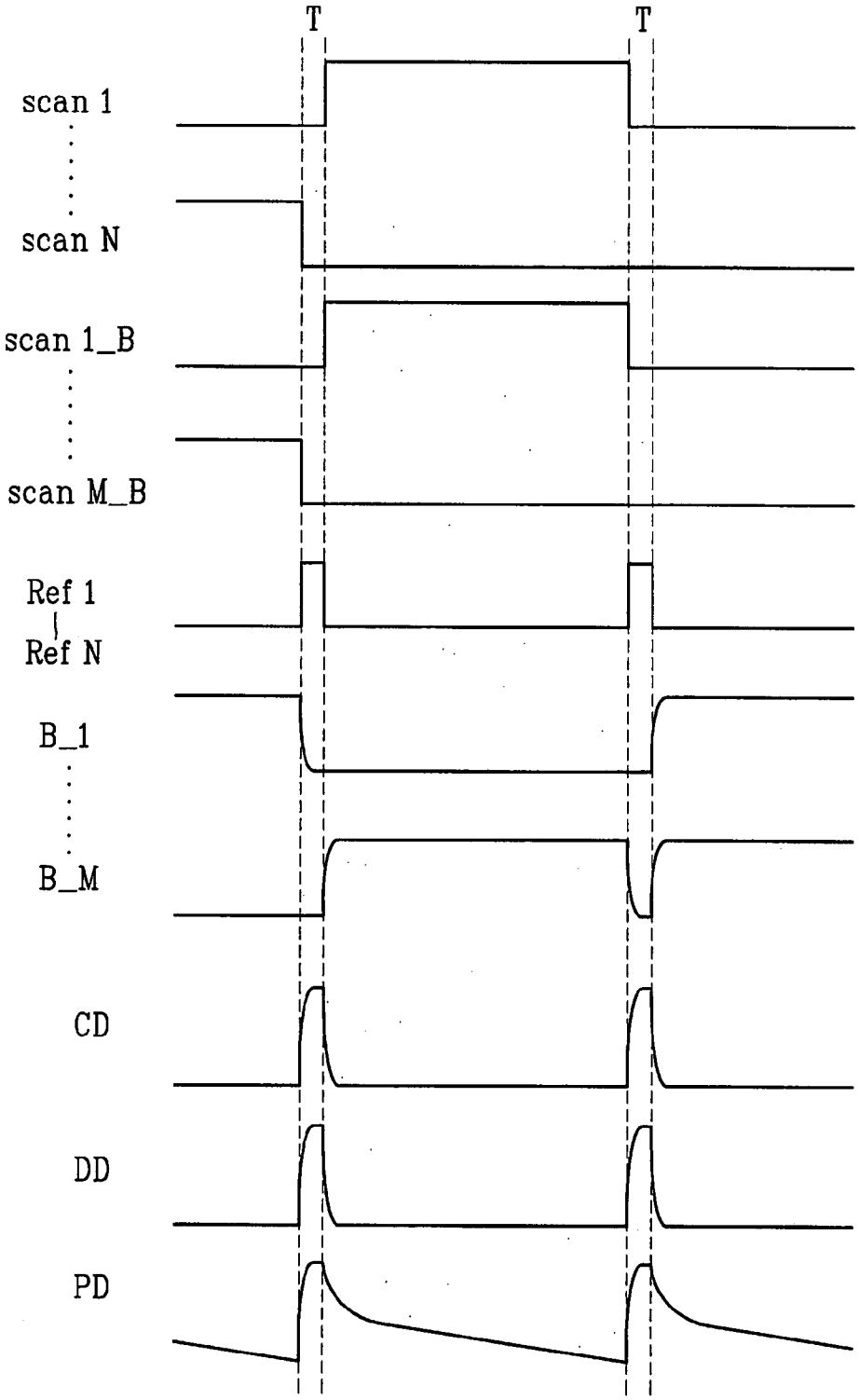

FIGS. 7 and 8 illustrate operation waveforms at parts in FIG. 6.

Referring to FIGS. 7 and 8, parts represented with 'T' are refresh periods, during which the controller (not shown) controls such that all data lines and all scan lines are connected to ground, for having low signals. The data line represents one of elements of the data driving part, which has N data lines. The scan line represents one of elements of the scan driving part, which has N scan lines.

A smallest unit of an organic EL driving circuit includes the data line, a plurality of light emitting devices connected to the data line, an element in the data sink part in correspondence to the data line, and one scan line connected to the cathodes of the light emitting devices in common.

Referring to FIG. 7, when data signals, such as data 1–data N, are applied to the data lines, elements of the data sink part in correspondence to the lines, and connected to anodes of the light emitting devices in common are operative opposite to the data lines. However, corresponding signal waveforms are identical as shown in data 1_B and data N_B.

In this instance, all the data lines are grounded, and turned off during the 'T' time period, which is the refresh time period.

In correspondence to the signal waveforms of the data 1–data N, signal waveforms of A-1–A_N at respective anodes are as shown in FIG. 7. It can be noted that the signal waveforms of A-1–A_N vary with a slight time delays.

Elements in the scan controlling part in correspondence to the scan lines are operative opposite to the scan lines. However, corresponding signal waveforms are identical as shown in scan 1_B–scan M_B. The scan lines are also grounded during the 'T' time period, and turned off.

In correspondence to variation of the scan 1–scan M, waveforms of the B_1–B_M at respective cathodes vary as shown in FIG. 8. The waveforms of the B_1–B_M are also varied with a slight time delays.

In the meantime, voltages applied to all the scan lines drop from the inverse voltage Vpp to the ground, except selected one line, and the voltage applied to another scan line selected again in succession rises from the ground to a Vpp level.

Thus, upon dropping the data signals and the scan signals applied to the data driving part and the scan driving part to the ground utilizing the refresh time period 'T', a responsive time period can be shortened substantially, and the current required for an entire operation can be reduced substantially.

Though the refresh schema exhibits a substantial effect in view of a current used for driving in a case the current required for the driving is much, it is difficult to have an effect of reduction of the current used for the driving because the current consumed at the refresh schema is substantially much in a case the current required for the driving is not much.

Accordingly, there may be the following two methods for utilizing a power wasted at the refresh schema.

One is a method in which a power consumption is reduced, which is occurred as the data signals on the data lines are dropped from high signals to ground during the 'T' time period, the refresh time period, and turned to the high signals again at a time point the refresh time period ends.

The other is a method in which a power consumption is reduced, which is occurred as the scan signals on the scan lines are dropped from high signals to ground during the 'T' time period, the refresh time period, and turned to the high signals again at a time point the refresh time period ends.

The scan line signals have high signal values for most of entire scan time period, and are turned to low signal values for only a selected one scan time period. Therefore, because the scan line signal repeats charging/discharging in which the scan line signal is discharged during the refresh time period in the continuous high signal period, and charged at a time point the refresh time period ends, the power consumption becomes greater. The data line also has the same problem when the data line has much continuous high signal.

Therefore, since there is much current flowing during the refresh time period, the source terminals of the data 1_B–data N_B, the N sink elements, are connected together, and therefrom connected to the input of the transformer 10*d*.

The ref1–refM, refresh elements, are respectively connected between the scan1–scanM, M scan driving circuits and scan 1_B–scan M_B, inverse voltage elements in the scan controlling part. Drain terminals of the ref1–refM are connected to cathodes of the light emitting device part 60 respectively, and source terminals of the ref1–refM are connected together, and therefrom to the input of the transformer 10*d*.

Therefore, there is much current flowing to the input of the transformer 10*d* during the moment of refresh time period. That is, a current with a waveform of 'CD' part shown in FIGS. 7 and 8 in common is applied.

The momentary current flowing thus forms a flow of charge at an output terminal having a winding ratio of 1:M in the transformer 10*d*. That is, the output terminal becomes to have a waveform of 'DD' part shown in FIGS. 7 and 8 in common, and provides a certain voltage to the controlling part 20*d* connected to the next stage.

The voltage formed to a certain level under the control of the controller 20*d* is applied to the power source part 30 of entire system through the diode 40*d*. That is, the voltage has a waveform of a 'PD' part shown in FIGS. 7 and 8 in common.

Thus, the recovery and reuse of the power consumed at the refresh schema permits to reduce a power of the entire system.

Figure 9:
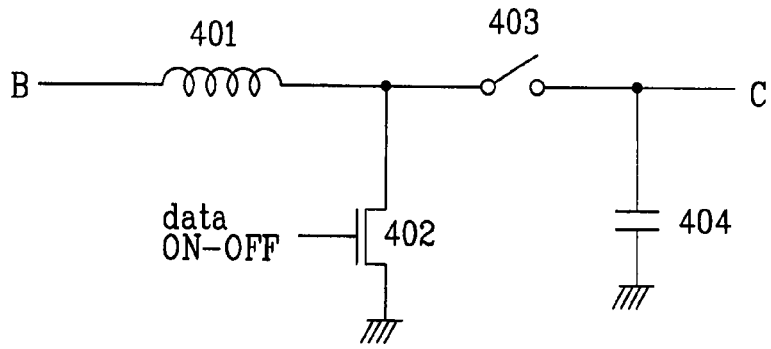
FIG. 9 illustrates an example showing an inductor used as the voltage transformer in FIGS. 2, 4 or 6.

FIG. 9 illustrates an example of an inductor used in a power saving circuit for a display of a current driven type in accordance with the first, second or third embodiment of the present invention, wherein one side of the data sink part, i.e., sources of the NMOSs, are connected to the inductor in common.

That is, at least one of the N data sink parts (or scan driving parts) is turned on, an anode voltage (a voltage as point 'A'–'N') of a relevant light emitting device is charged to the coil 401 through a relevant data sink part.

If a switching device 402 is turned off, other switching device 403 is turned on. Thereby, the voltage charged to the coil 401 is charged to the capacitor 404. The voltage charged to the capacitor 404 is applied to a power source part through the diode.

Figure 10:
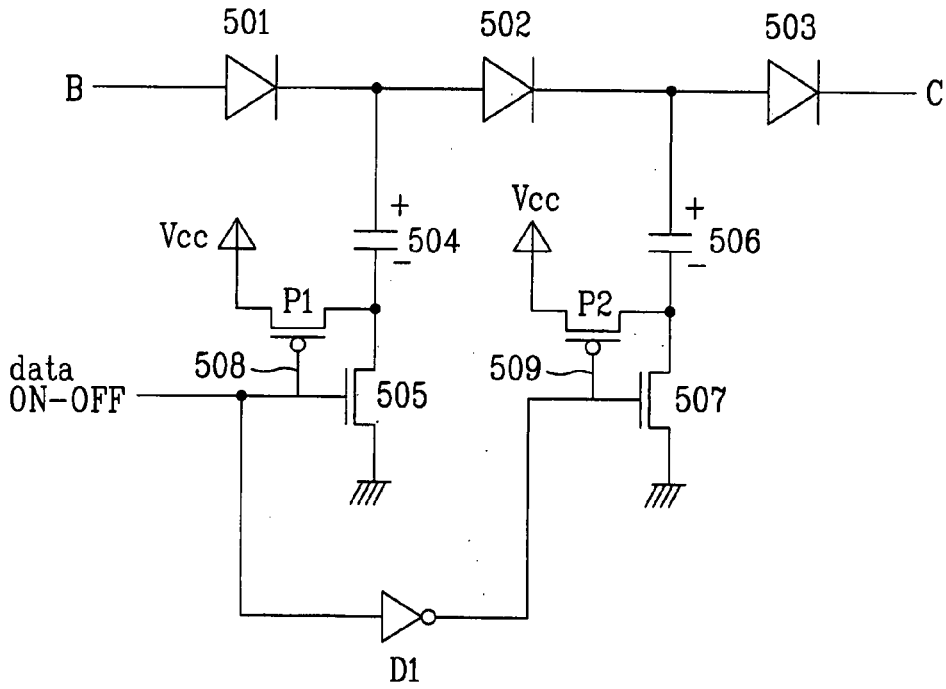
FIG. 10 illustrates an example showing a charge pump used as the voltage transformer in FIGS. 2, 4 or 6.
Figure 11:
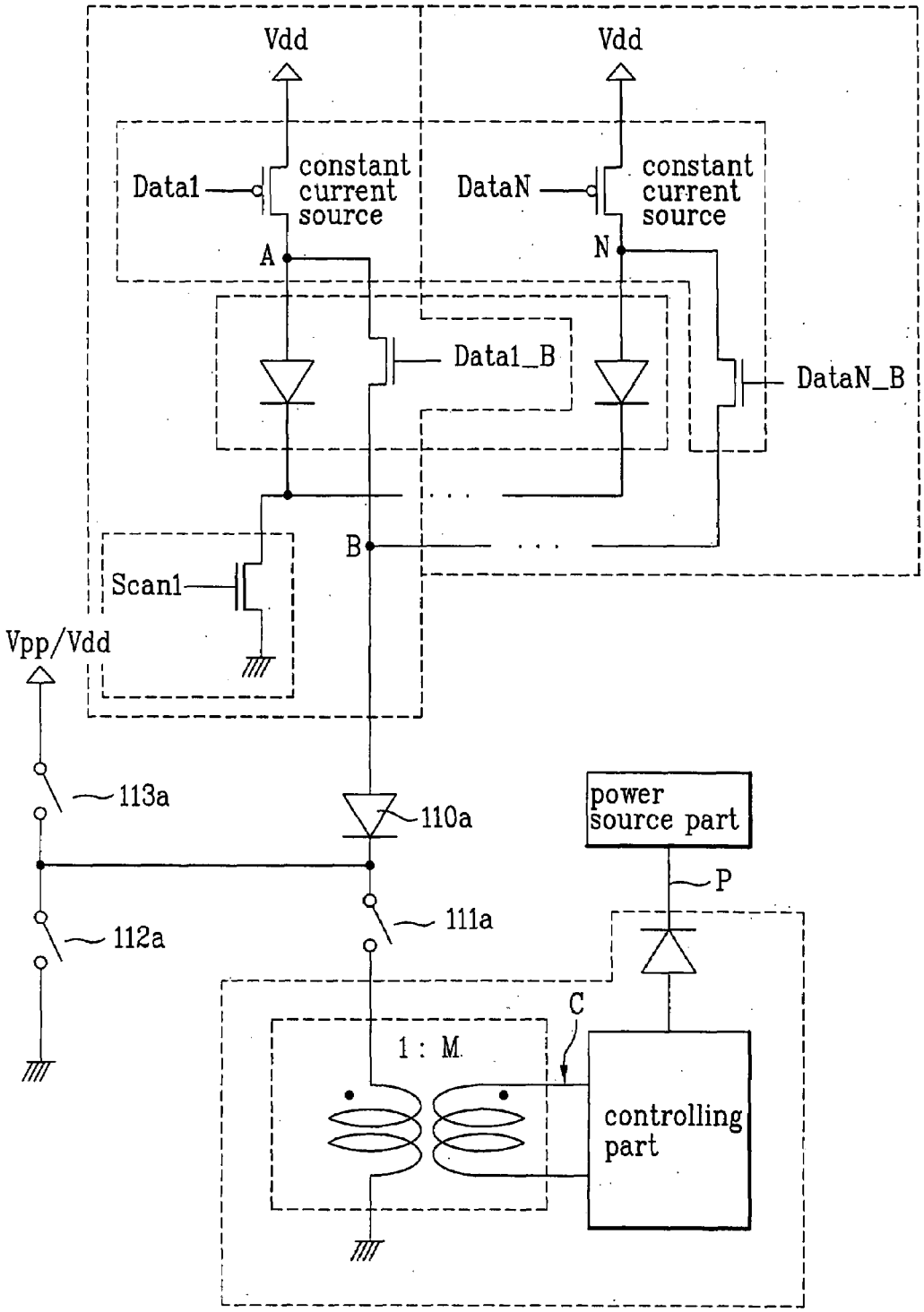
FIGS. 11–13 illustrate examples showing a connection of a switch and a diode with the voltage transforming part.
Figure 12:
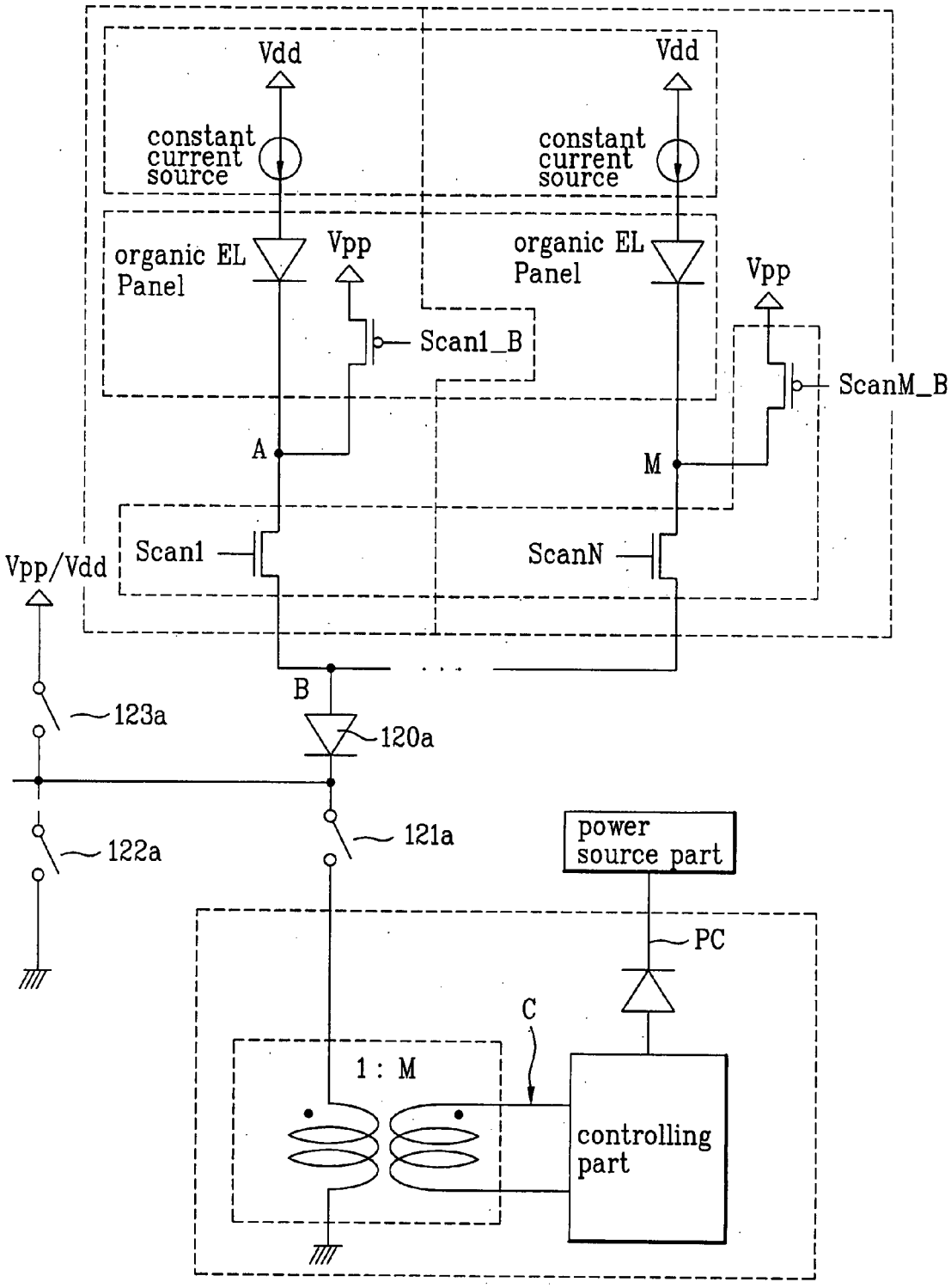
Figure 13:
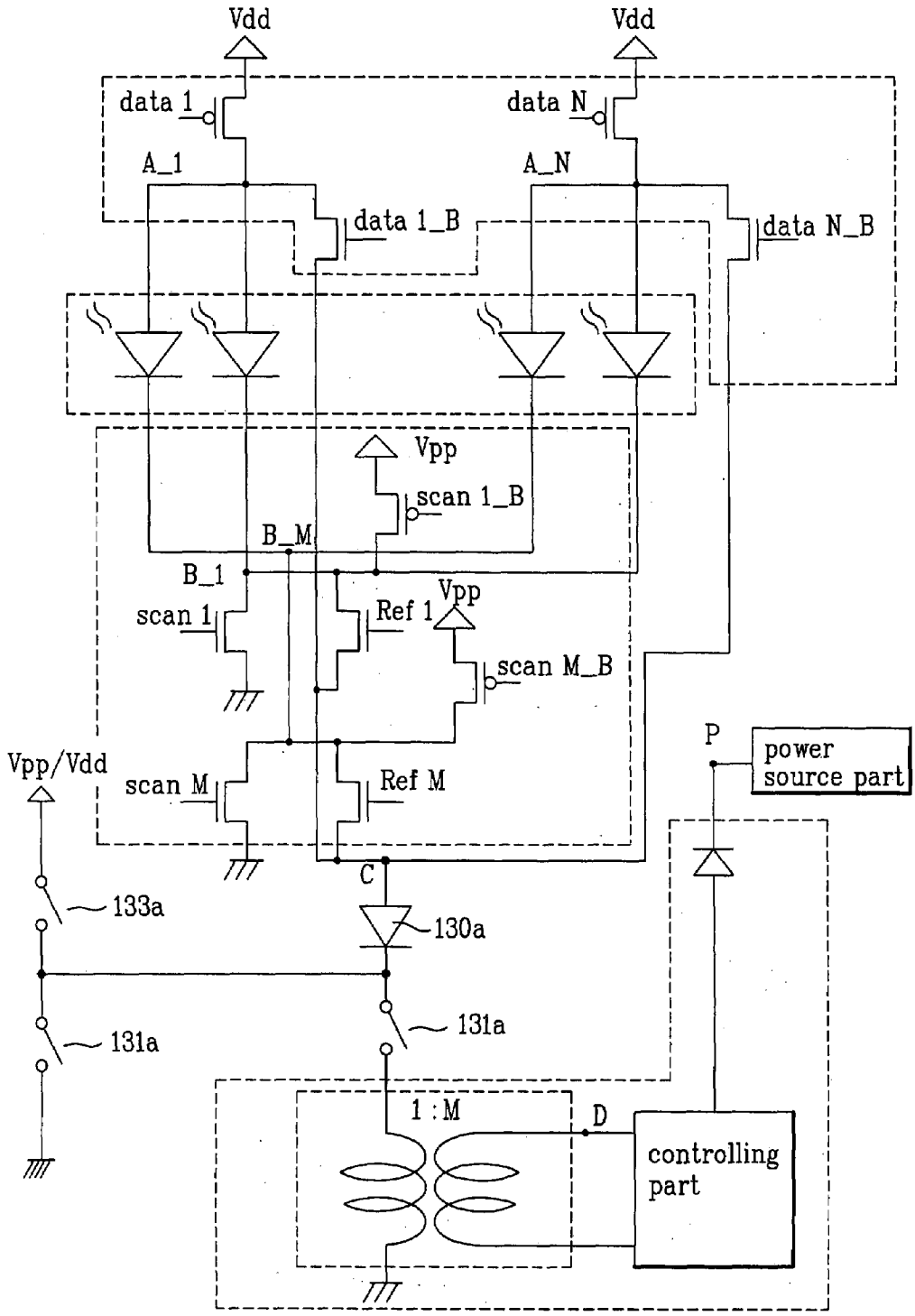

FIG. 10 illustrates an example of a charge pump used in a power saving circuit for a display of a current driven type in accordance with the first, second, or third embodiment of the present invention, wherein the charge pump boosts a received voltage to a voltage of a preset level. As shown, the charge pump includes diodes 501, 502, 503; capacitors 504, 506; NMOS transistors 505, 507; and PMOS transistors 508, 509, FIGS. 11–13 illustrate examples showing a connection of a switch and a diode with the voltage transforming part. That is, FIGS. 11–13 illustrate circuits showing exemplary applications in which a diode 110*a* is connected to a connection part of the voltage transforming part, so that a voltage caused by an electromotive force generated at an inductor gives no influence to other circuit, or switch devices 111*a*, 112*a*, and 113*a* are connected to the connection part of the voltage transforming part for stable operation and noise reduction of the voltage transforming part.

At a moment N number of the data sink parts are turned on, or during one of M number of scan driving parts is turned on, there is a momentary large current flowing to an input of the voltage transforming part. This momentary current forms a charge flow at an output terminal of the transformer, leading to form a certain voltage at an output terminal of the voltage transforming converter by the operation of the voltage transforming converter. The voltage is provided to a power source terminal of an entire system, to reduce a power for the entire system.

As has been explained, the power saving circuit for a display of a current driven type of the present invention has the following advantages.

First, the power recovering circuit can drop an entire driving current.

Second, the recovery and re-use of the current used at the refresh schema can reduce a power used at the refresh schema.

Third, the recovery and re-use of the current wasted at the data sink part can reduce a total power of a display of a current driven type.

Fourth, the recovery and re-use of the current wasted at the scan driving part can reduce a total power of a display of a current driven type.

It will be apparent to those skilled in the art that various modifications and variations can be made in the circuit and method for driving a display of the present invention without departing from the spirit or scope of the invention. Thus, it is intended that the present invention cover the modifications and variations of this invention provided they come within the scope of the appended claims and their equivalents.

What is claimed is:

1. A circuit for driving a display comprising:

a light emitting display of a current driven type having a plurality of column electrode lines arranged in a column direction, a plurality of row electrode lines arranged perpendicular to the column electrode lines, and a matrix of pixels at crossing points of the column electrode lines and the row electrode lines;

a power source part;

a column driving circuit connected to the column electrode lines formed in the column direction for supplying/discharging a current to/from the column electrode lines, for driving a light emitting element of the light emitting display of current driven type; and an electric transformer for, when the current supplied to the column electrode lines is discharged, recovering the current discharged from the column electrode lines and re-supplying a recovered current to the power source part, wherein the column driving circuit includes a data sink part having a first end coupled to an anode line of the light emitting element and a second end coupled to ground through the electric transformer such that a trapped charge at the anode line of the light emitting element is transferred to the electric transformer.

2. A circuit for driving a display comprising:

an organic EL display of a current driven type having a plurality of column electrode lines arranged in a column direction, a plurality of row electrode lines arranged perpendicular to the column electrode lines, and a matrix of pixels at crossing points of the column electrode lines and the row electrode lines;

a power source part;

a column driving circuit connected to the column electrode lines formed in the column direction for supplying/discharging a current to/from the column electrode lines, for driving a light emitting element of the organic EL display; and an electric transformer for, when the current supplied to the column electrode lines is discharged, recovering the current discharged from the column electrode lines and re-supplying a recovered current to the power source part, wherein the column driving circuit includes a data sink part having a first end connected to an anode line of the light emitting element and a second end connected to the electric transformer such that a trapped charge at the anode line of the light emitting element is transferred to the electric transformer, wherein the second end of the data sink part is connected to a ground through the electric transformer.

3. The circuit of claim 2, wherein the data sink part includes an NMOS transistor having the first end connected to the anode line and the second end connected to the electric transformer.

4. The circuit of claim 3, wherein the first end corresponds to a drain of the NMOS transistor and the second end corresponds to a source of the NMOS transistor.

5. The circuit of claim 4, wherein the source of the NMOS transistor is connected to a primary side coil of the electric transformer.

6. The circuit of claim 1, wherein the data sink part includes an NMOS transistor having the first end connected to the anode line and the second end connected to the electric transformer.

7. The circuit of claim 6, wherein the first end corresponds to a drain of the NMOS transistor and the second end corresponds to a source of the NMOS transistor.

8. The circuit of claim 7, wherein the source of the NMOS transistor is connected to a primary side coil of the electric transformer.

* * * * *